US008096386B2

(12) United States Patent
Vaherto

(10) Patent No.: US 8,096,386 B2
(45) Date of Patent: Jan. 17, 2012

(54) ACTIVELY REGULATED ELECTROMECHANICAL CONTROLLER FOR FORK LIFT TRUCK

(76) Inventor: Jyri Vaherto, Vaajakoski (FI)

( * ) Notice: Subject to any disclaimer, the term of this patent is extended or adjusted under 35 U.S.C. 154(b) by 479 days.

(21) Appl. No.: 12/311,454

(22) PCT Filed: Oct. 4, 2007

(86) PCT No.: PCT/FI2007/050541

§ 371 (c)(1),
(2), (4) Date: Mar. 30, 2009

(87) PCT Pub. No.: WO2008/040853

PCT Pub. Date: Apr. 10, 2008

(65) Prior Publication Data

US 2009/0326717 A1 Dec. 31, 2009

(30) Foreign Application Priority Data

Oct. 4, 2006 (FI) ..... 20065637

(51) Int. Cl.
*B66F 9/20* (2006.01)

(52) U.S. Cl. ..... 187/224; 701/50

(58) Field of Classification Search ..... 187/222, 187/223, 224, 233, 237, 277, 394, 404; 701/29, 701/50, 124
See application file for complete search history.

(56) References Cited

U.S. PATENT DOCUMENTS 5,088,020 A * 2/1992 Nishida et al. ..... 700/40
5,225,831 A * 7/1993 Osborn ..... 341/20
5,329,441 A * 7/1994 Aoki et al. ..... 701/50
6,138,795 A * 10/2000 Kamiya ..... 187/223
6,170,606 B1 * 1/2001 Merz ..... 182/2.1
6,175,796 B1 * 1/2001 Ishikawa ..... 701/50
6,269,913 B1 * 8/2001 Kollmannsberger et al. . 187/394
6,272,413 B1 * 8/2001 Takahashi et al. ..... 701/50
6,296,081 B1 * 10/2001 Nagai et al. ..... 187/394
6,595,330 B1 * 7/2003 Henrickson et al. ..... 187/277
6,785,597 B1 * 8/2004 Farber et al. ..... 701/50
2007/0065271 A1 3/2007 Merin

FOREIGN PATENT DOCUMENTS

GB 2 196447 4/1988
JP 10-182095 7/1998
JP 2000-229794 8/2000

* cited by examiner

*Primary Examiner* — Anthony Salata

(74) *Attorney, Agent, or Firm* — Fildes & Outland, P.C.

(57) ABSTRACT

The invention relates to a method for controlling the load-handling elements of a fork-lift truck, the load-handling elements being used in the method to grip the load to be handled. The load-handling elements are operated using an electrically controlled operating device, which is controlled using an analog control voltage formed using an electromechanical controller. In addition, the analog control voltage coming from the electromechanical controller is regulated actively externally on the basis of measurement data and set criteria, before the analog control voltage formed by the electromechanical controller is conducted to the electrically controlled operating device. The analog control voltage coming from the electromechanical controller is regulated using a feed external to the electromechanical controller, in parallel with the electromechanical controller. The invention also relates to a corresponding operating system and regulating apparatus.

11 Claims, 4 Drawing Sheets

ACTIVELY REGULATED ELECTROMECHANICAL CONTROLLER FOR FORK LIFT TRUCK

TECHNICAL FIELD

The present invention relates to a method for controlling the load-handling elements of a fork-lift truck, the load-handling elements being used in the method to grip the load to be handled and the load-handling elements being operated using an operating element, which is controlled using an analog control voltage formed using an electromechanical controller, by means of an electrically-controlled directional control valve. The invention also relates to a corresponding operating system and regulating apparatus.

BACKGROUND OF THE INVENTION

Methods are known from the prior art, in which the operator uses an electromechanical controller to control the operating device of the load-handling element of a fork-lift truck. On the basis of the analog control voltage formed by the electromechanical controller, an electrically controlled directional control valve operates the operating device. A solution according to the prior art is presented, for example, in the book Vehicle and Implement Hydraulics (Ajoneuvo-ja työkonehydrauliikat (in Finnish)), particularly on pages 74-77, (Louhos, P. & Louhos J-P., 1992. Ajoneuvo-ja työkonehydrauliikat. Kangaslampi: Karjala-dealers KY. 268 pp.) The operating device operates the load-handling elements, which can be, for example, the forks or grabs of a truck. The operating device and directional control valve are part of a control element. When using such an apparatus to handle loads which, for example, should be lifted by gripping them from the sides with grabs, the loads can be damaged by excessive pressure. When the loads are of different sizes, during lifting they should be gripped with a precisely suitable force, which varies from load to load. When using such an apparatus to handle loads, the operator is very important, as they adjust the compressive force by using an electromechanical controller to control the operating device. If the operator keeps the electromechanical controller in the 'on' position for too long, the grab will compress the load with an excessive force. The apparatus described above is used in Linde E 14—20-type fork-lift trucks, among others. The apparatus described is also used in many other fork-lift trucks, in which there is electrical pre-control. In such a known device, the operating device is controlled using an analog control voltage formed by an electromechanical controller, by means of an electrically controlled proportional valve. The proportional valve permits, for example, exactly the desired gripping pressure or lifting speed.

In FIG. 3, the solid lines are used to show how the analog control voltage depends on the position of the controller. The analog control voltage of the potentiometer can be, for example, 5, 12, 14, or 24-V direct current. In an electromechanical controller, for example in a joystick, there can be one or more sliders, i.e. potentiometers. When the controller contains several potentiometers, they can be in different directions, so that when the voltage of one increases the voltage of another decreases. This is precisely the case in the graph shown in FIG. 3. When the first voltage, which is shown by the line 10, rises, the second voltage, which is shown by the line 10', drops. In the case of several potentiometers, the voltages can also be stepped, in which case one will be slightly more than another. If the difference in the voltage coming from the sliders is unexpected, the operating system terminates the control for safety reasons.

The signal coming from the electromechanical controller can be cut and replaced with an entirely new signal. The new signal comes from a new controller. The electromechanical controller is then replaced with a more intelligent control system. Cutting the signal coming from the electromechanical controller and replacing it with a new signal is, however, in no way without its problems, as a difference can easily appear in the voltages coming from the sliders. The operating device interprets the difference in question as an error and terminates the control for safety reasons. For this reason, cutting a signal coming from the electromechanical controller and replacing it with a new signal is very challenging. Even though the signal monitored by the operating device may only deviate for a short moment, the monitoring may be timed for exactly that moment. In some systems, resetting the error is difficult and must be performed by a maintenance technician.

On the other hand, apparatuses are known from the prior art, in which digital control signals are edited. In addition, apparatuses are known from the prior art, in which the control pressure is adapted. Examples of such apparatuses are publications JP 7-109095 and JP 5-238686. The apparatuses in question permit the operating device to be controlled in such a way that the load is not pressed too tightly, for example. Such apparatuses, which alter the control pressure of the digital control signal, are easy to install during the manufacture of the truck. The entire control system is then manufactured taking the totality into account. However, there is a problem with trucks that have already been manufactured, in which there is already a control system without the adaptation of a control variable, for example, the control signal or control pressure.

SUMMARY OF THE INVENTION

The invention is intended to create a new type of method, which will eliminate the aforementioned problems and permit a more precise control of the load-handling elements than previously. The characteristic features of the present invention are, that the analog control voltage coming from the electromechanical controller is regulated actively externally on the basis of measurement data and set criteria, before the analog control voltage formed by the electromechanical controller is conducted to the electrically controlled operating element, and the analog control voltage coming from the electromechanical controller is regulated relative to the electromechanical controller by an external feed in parallel with the electromechanical controller. The invention also relates to a corresponding operating system, by means of which the control of the load-handling elements can be managed more precisely than previously. The characteristic features of the operating system according to the present invention are, that the operating system includes regulating means, which are arranged to actively regulate as desired the analog control voltage arranged to come from the electromechanical controller, before the analog control voltage arranged to come from the electromechanical controller is conducted to the electrically controlled operating element, connecting means for connecting the regulating means in parallel with the electromechanical controller, an active control system for controlling the regulating means, and at least one sensor for obtaining measurement data for the control system. In addition, the invention relates to a corresponding regulating apparatus, which can be connected to a fork-lift truck, in addition to the already existing control system. The characteristic features of the regulating apparatus according to the present invention are that the regulating apparatus includes connecting means for connecting the regulating apparatus to the connection cabling in parallel to the electromechanical controller, regulating means, which are arranged to actively regulate as desired the analog control voltage arranged to come from the fitted electromechanical controller, before the analog control voltage goes to the directional control valve, an active control system in order to control the regulating means, and at least one sensor for obtaining measurement data for the control system.

Fork-lift trucks are used to handle many different kinds of load, which they must grip in order to handle them. The load can be gripped in many different ways, examples of which are forks and grabs. Gripping with forks takes place indirectly, for example, by lifting a load pallet, on which the load is placed. Gripping with a grab takes place by directly gripping the load, or indirectly by gripping the package surrounding it. In special cases, the gripping element can be, for example, a cradle intended for lifting people, in which case the load is the cradle and the people. The load-handling elements of the truck are controlled, to allow the desired grip on the load to be obtained for handling the load. The load-handling elements are operated by an operating element. The operating element includes an operating device. A hydraulic cylinder, for example, can act as the operating device. The operating element is controlled by an analog control voltage formed by an electromechanical controller. In addition, the control voltage coming from the electromechanical controller is actively regulated externally on the basis of measurement data and set criteria, before the analog control voltage is conducted to the operating element, and the analog control voltage being regulated by a feed external to the electromechanical controller and in parallel with the electromechanical controller. Thus the regulation is used at least partly to replace the analog control voltage coming from the electromechanical controller. The term external regulation refers to regulation, which is external when the situation is examined from the point of view of the electromechanical controller. The external regulation is used to interfere in the analog control situation, which, as is known, has gone directly from the electromechanical controller to the electrically controlled operating element. The measurement data, on the basis of which the active external regulation is implemented, can concern many factors relating to the load-handling element and the load. Such are, for example, height, compressive force, the vertical velocity of the load, the weight of the load, or the degree of tilt of the truck's boom. The measurement data, for their part, are compared with set criteria. In practice, for example when the speed of movement of the load reaches a limit permitted by a criterion, the analog control voltage is regulated, so that the criterion set for the speed will not be exceeded. The regulation takes place in parallel with the electromechanical controller, by at least partly replacing the analog control voltage coming from the electromechanical controller.

In one embodiment, the criteria are set using the user interface. When the criteria are set using the interface, the operation of the operating system becomes very smooth, compared to an operating system, in which there are fixed limits. The criteria that are changed using the interface permit very many different kinds of load to be handled exactly as desired. The criteria can be set using the interface, either as numerical values, or else the interface can be used to select from a library the data on the load being handled, in which case the control system itself will know the correct limits.

In a second embodiment, the analog control voltage coming from the electromechanical controller is loaded using an active analog control voltage. When the analog control voltage coming from the controller is loaded, the control voltage conducted to the operating element drops. Thus the operation of the operating element does not depend only on the analog control voltage coming from the electromechanical controller.

In a third embodiment, the analog control voltage coming from the electromechanical controller is fed using an active analog control voltage. When the analog control voltage coming from the controller is fed, the analog control voltage going to the operating element increases. Thus the operation of the operating element and in turn the operating device does not depend only on the analog control voltage coming from the electromechanical controller.

In a fourth embodiment, the analog control voltage coming from the electromechanical controller is limited using an active control voltage. When the analog control voltage coming from the electromechanical controller is limited using an active control voltage, the control voltage conducted to the operating element depends only partly on the analog control voltage coming from the electromechanical controller. As the limiting of the control voltage is active, it is performed on the basis of measurement data and set criteria. By limitation the control voltage coming from the controller, it is possible to achieve a very advantageous embodiment, in which the control of the electrically controlled operating element is based on the control voltage created by the electromechanical controller, which is limited by active external control. In other words, the control voltage created by the electromechanical controller is limited by an active control voltage, after which the controlled voltage goes in its limited form to the operating element. The active external limited of the control voltage coming from the controller is advantageous, because the operator can then control the device in the known manner using the electromechanical controller while the regulating apparatus assists the operator on the basis of the measurement data and the set criteria. Control is then based to a substantial extent on the control voltage created by the electromechanical controller. The use of the limiting of the control voltage assists the operator in work, as the regulating apparatus assists the operator particularly, for example, in places requiring extreme precision. In addition, when using an electromechanical controller, the work takes place in an accustomed manner, thus avoiding dangerous situations that might arise when using an entirely new type of control system.

In a fifth embodiment, the control voltage coming from the electromechanical controller is replaced with an active control voltage. When the analog control voltage coming from the electromechanical controller is replaced with an active control voltage, the control voltage conducted to the operating element does not depend on the analog control voltage coming from the electromechanical controller. When the analog control voltage coming from the electromechanical controller is replaced, the replacement takes place by regulating the analog control voltage relative to the electromechanical controller by means of an external feed in parallel with the electromechanical controller. By means of the replacement of the control voltage coming from the controller, a highly advantageous embodiment is achieved, in which the control of the electrically controlled operating element is not based on a control voltage created using the electromechanical controller, but instead the control voltage coming from the controller is replaced with an active control voltage. When the control voltage coming from the controller is replaced with an active control voltage, the electrically controlled operating element can be operated independently of the control voltage coming from the controller. The active external control, in which the control voltage coming from the controller is replaced with an active control voltage, permits the external control to be based entirely on the measurement data and the set criteria. The active replacement of the control voltage is advantageous, because the device is then not controlled using the electromechanical controller, but instead it has been able to be replaced entirely with an external regulating apparatus. When the regulating apparatus controls the electrically controlled operating element, sub-functions that can be automated can be performed, for example computer-controlled, on the basis of measurement data and set criteria. The replacement of the control voltage coming from the controller assists the operator in work, as part of the routine work, or work that requires extreme precision can be handled using the separate regulating apparatus. On the other hand, when the external replacement control is switched off, the control can be operated in completely the familiar manner.

In a sixth embodiment, control voltage coming from the electromechanical controller is limited at different times and replaced with an active control voltage. In other words, the analog control voltage coming from the controller is limited at different times and replaced, relative to the electromechanical controller, with an external feed in parallel with the electromechanical controller. In this embodiment, the beneficial properties of limiting the control voltage coming from the controller, and of replacing it are combined, so that the handling of loads is very reliable in many different work situations. The limiting of the control voltage coming from the controller assists the operator, as the operating system can be controlled using electromechanical control devices. For its part, at intervals the control voltage coming from the controller is replaced with an active control voltage, when control takes place independently of the electromechanical control means. In addition, both functions can be switched off, then the control voltage will travel from the electromechanical controller to the electrically controlled operating element, in the manner of the prior art.

In the following, the invention is described in detail with reference to the accompanying drawings showing some embodiments of the invention, in which

DETAILED DESCRIPTION OF THE INVENTION

Figure 1:
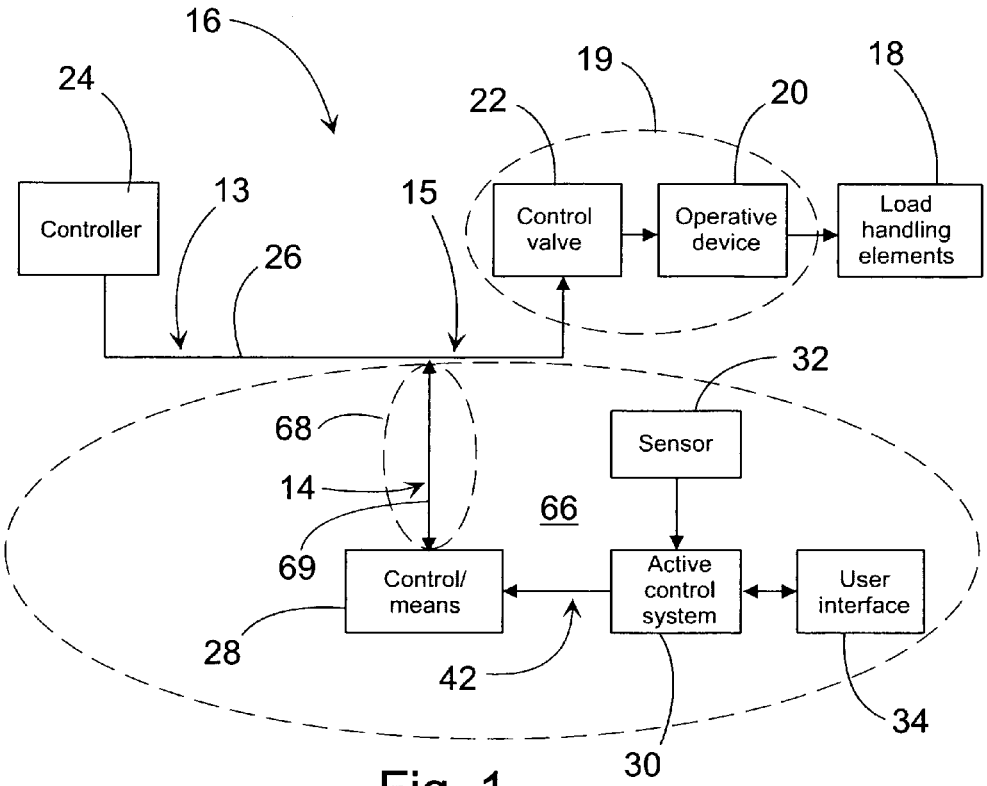
FIG. 1 shows a diagram of the operating system according to the invention.

FIG. 1 shows a diagram of the operating system 16 of the load-handling elements 18 of a fork-lift truck according to the invention. The truck includes load-handling elements 18, by means of which loads are gripped in order to handle them. The load-handling elements can be, for example, the forks or grabs of the truck. The operating system 16 of the truck includes an operating element 19, an electromechanical controller 24, connection cabling 26. The operating element 19 is arranged to operate the load-handling elements 18. The electromechanical controller 24 is arranged to form an analog control voltage 13, by means of which the operating element 19 is controlled. The connection cabling 26 runs between the electromechanical controller 24 and the electrically controlled operating element 19. The connection cabling 26 is used to transmit the analog control voltage formed by the electromechanical controller 24 to the electrically controlled operating element 19. In addition, the operating system 16 includes control means 28, connection means 68, and active control system 30, and a sensor 32. The control means 28 are arranged to actively regulate the analog control voltage coming from the electromechanical controller as desired. The analog control voltage is regulated on the basis of external measurement data and set criteria and the regulating takes place before the analog control voltage 13 coming from the electromechanical controller is conducted to the operating element 19. By means of the connection means 68, the control means 28 are connected to the connection cabling 26 between the electromechanical controller 24 and the electrically controlled operating element 19, in parallel with the electromechanical controller 24. The active control system 30 is used to control the control means 28. The sensor 32 is used to obtain the measurement data for the control system 30. In other words, the operating system 16 includes a regulating apparatus 66, in order to regulate the analog control voltage coming from the electromechanical controller 24. The regulation can be from the loading or from the feeding. Thus the control of the load-handling elements takes place using the regulating apparatus, in addition to the electromechanical controller. Thus the handling of loads can take place more precisely than previously. The operating system according to the invention can be utilized in connection with many different kinds of operating element.

Compared to the regulation of a digital control signal, the regulation of the analog control voltage can be easily implemented even using a retrofitted apparatus. Compared to the regulation of pressures, the analog control voltage can be regulated using a considerably smaller apparatus. Regulation of the analog control voltage is advantageous, as the analog control voltage used in fork-lift trucks and the corresponding current are at a level that can be loaded or increased without any problems. The voltage is typically in the order of tens of volts while the current is from a few milliamperes to a few tens of milliamperes. The impedance of the electromechanical controller is typically from a few ohms to a few tens of ohms. There is a resistor next to the potentiometer of the electromechanical controller for the control means to stand the required loading/feed without burning out.

In the diagram shown in FIG. 1, the operating element 19 includes an operating device 20 for operating the gripping element 18, as well as an electrically controlled directional control valve 22 for operating the operating device 20. The operating device can be, for example, a hydraulic cylinder.

Though hereinafter in the description portion of the present application reference is constantly made to the directional control valve and the operating device, it should be remembered that they form the operating element. The operating element can consist of other components too, in addition to the directional control valve and the hydraulic cylinder acting as the operating device. The directional control valve and the hydraulic cylinder can be replaced with a system operating in an analog manner, such as an electric motor and electric control logic. The operating element thus includes some hydraulic and/or electric control system, for example, a directional control valve, as well as an operating device.

In the operating system according to the invention, shown in FIG. 1, the load-handling elements 18 are operated using an operating device 20. The operating device is hydraulically operated and can be, for example, a hydraulic cylinder. The directional control valve is electrically controlled, i.e. the directional control valve 22 receives commands electrically as an analog control voltage 15 and converts them into pressures in the hydraulic apparatus, in order to control the operating device 20. The directional control valve is typically a proportional valve. The directional control valve 22 is controlled by an electromechanical controller 24, together with the regulating apparatus 66. In other words, the regulating apparatus 66 is connected in parallel with the electromechanical controller 24. The electromechanical controller 24 is used to form an analog control voltage 13, which is adapted as desired using the regulating apparatus 66, so that the analog control voltage 15 is conducted to the electrically operated directional control valve 22. Between the electromechanical controller 24 and the electrically controlled directional control valve 22 there is connection cabling 26, for transmitting the analog control voltage 15 to the directional control valve. The operating system 16 includes an control means 28 connected by connection means 68 to the connection cabling 26 between the electromechanical controller 24 and the electrically controlled directional control valve 22, in order to regulate the analog control voltage (15) coming to the directional control valve 22 as desired. From the control means 28, active analog control voltage 14 travels along a connector cable 69 to the connection cabling 26. The active analog control voltage 14 can be used to limit or replace the analog control voltage 13 coming from the electromechanical controller. The term limiting refers to the fact that the value of the analog control voltage (13) coming from the electromechanical controller (24) affects the value of the analog control voltage 15 going to the directional control valve 22. The term replacing refers to the fact that the value of the analog control voltage 13 coming from the c electromechanical controller 24 does not affect the value of the analog control voltage 15 going to the directional control valve 22. When the analog control voltage coming from the electromechanical controller is limited or replaced, the control means 28 are connected in parallel with the electromechanical controller 24. The control means 28 are controlled by an active control system 30, which receives measurement data from at least one sensor 32. The operating system 16 preferably also includes a user interface 34. The user interface is used to set the operating criteria of the control means. When setting criteria using the user interface, the operation of the operating system is made very smooth, compared to an operating system, in which there are fixed criteria. The criteria se using the interface permit very many different kinds of load to be handled exactly as desired.

The operating system 16 shown in FIG. 1 includes a regulating apparatus 66, by means of which the operating system 16 of the load-handling elements of the truck are controlled. For the directional control valve 22 operating the load-handling elements an analog control voltage 15 going to the directional control valve 22 is arranged to be formed. The sensor 32 forming part of the regulating apparatus 66 is used to measure a desired variable, on the basis of which the active control system 30 forming part of the regulating apparatus 66 is used to form an auxiliary control signal 42. The auxiliary control signal, by means of which the loading elements and feed elements are controlled, can be digital or analog. The control means 28 forming part of the regulating apparatus 66 are controlled using the auxiliary control signal 42. The control means regulate the analog control voltage going to the directional control valve as desired, on the basis of the measurement data and the set criteria. The regulating apparatus 66 preferably includes, in addition, a user interface 34 for setting the criteria.

Figure 2A:
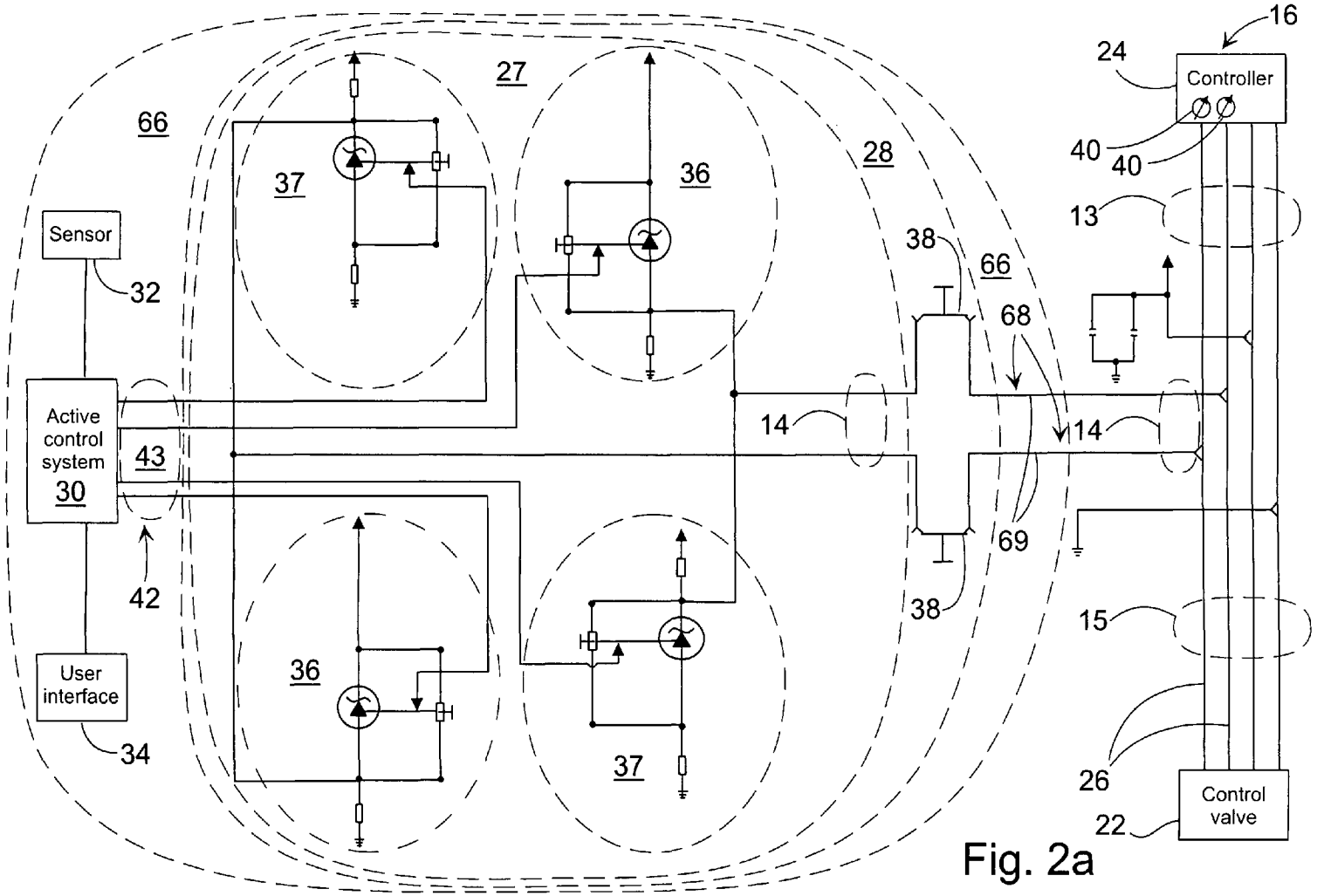
FIG. 2*a* shows a diagram of an implementation of the low-power control means according to the invention.
Figure 2B:
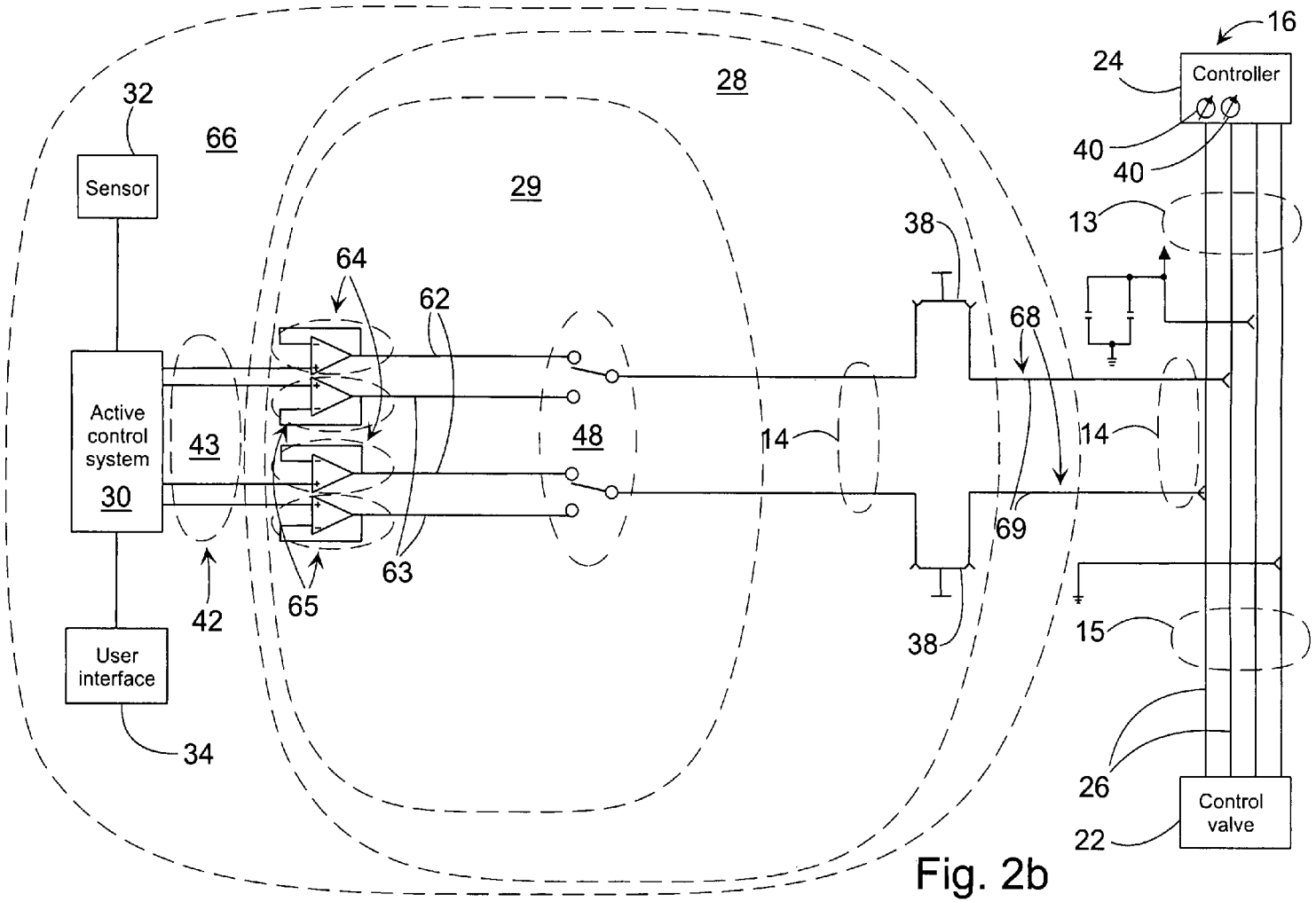
FIG. 2*b* shows a diagram of an implementation of the high-power control means according to the invention.

The control means 28 shown in FIG. 1 can be low-power control means 27, which are used to limit the analog control voltage 13 coming from the electromechanical controller 24 (FIG. 2*a*), or high-power control means 29, which are used to replace the analog control voltage coming from the controller 24 (FIG. 2*b*). Both the low-power control means 27 and the high-power control means 29 are connected in parallel with the electromechanical controller 24. The high-power control means 29 can be loaded/fed with current, in such a way that the analog control voltage 13 coming from the controller 24 can be replaced entirely. In that case, the analog control voltage going to the directional control valve will depend only on the high-power control means. In other words, if the control means are low-power, i.e. limiting means, the value of the analog control voltage ending up in the electrically controlled directional control valve will also depend on the position of the controller. If the control means are high power, i.e. replacement means the analog control voltage ending up in the electrically controlled directional control valve will not depend on the position of the controller. The difference between the low-power and high-power control means is examined in greater detail in connections with FIGS. 2*a* and 2*b*.

In the operating system according to the invention, shown in FIG. 1, the impedance of the electromechanical controller used is typically in the range 2-25 kΩ, preferably 5-20 kΩ. A loading or feed of a few watts can then be used to regulate as desired the analog control voltage going to the electrical directional control valve. Generally 5-95%, preferably 10-90% of this range is used. The operating system according to the invention is preferably used together with a controller, the range of which is not used fully, because in that case regulation can be performed more simply without danger of the controller burning out. The current is typically 1-20 mA, preferably 5-15 mA. The current produced by the regulating apparatus is generally in the range 100--100 mA, preferably 50--50 mA.

FIGS. 2*a* and 2*b* show a diagram of two embodiments and connections of the control means (28) belonging to the regulating apparatus 66 and the operating system (16) according to the invention. The connection of the regulating apparatus 66 and the control means 28 takes place to the connector cables 26 using connection means 68. The connection cables 26 run between the truck's directional control valve 22 and electromechanical controller 24. The controller 24 contains two potentiometers 40, from both of which a connector cable 26 runs to transmit the analog control voltage 14 to the electrically controlled directional control valve 22. There could also be one potentiometer, but in the preferred embodiment there are two potentiometers 40. The use of two potentiometers increases the operating reliability of the total system. The control means 28 are connected to the connector cables 26, and can, if desired, be disconnected from operation, using the connector switch 38 in them.

FIG. 2*a* shows the implementation and connection of the low-power control means 27, i.e. limiting means, acting as control means 28 in the operating system 16 according to the invention and regulating apparatus 66. The low-power control means 27 consist of loading elements 36 and feed elements 37. The analog control voltage 13 coming from both potentiometers 40 is limited as desired using the active analog control voltage 14 formed by loading elements 36, or the feed elements 37, depending on the situation. The operation of the loading elements 36 and the feed elements 37 is controlled using the auxiliary control signal 42 formed by the control system 30. The control system 30 is, in turn, connected to the sensors 32 and preferably also to the user interface 34. The loading and feed elements can be implemented using many different kinds of electronic connection semiconductors, among other things, can be utilized in their implementation. When the analog control voltage 13 coming from the potentiometers 40 in the controller 24 is regulated using the loading elements 36, they load part of the analog control voltage 13 away using the active analog control voltage 14. In turn, when regulating the analog control voltage 13 coming from the potentiometers 40 in the controller 24 using the feed elements 37, they feed additional current, thus compensating the load of the potentiometers 40 and increasing the analog control voltage 15 going to the directional control valve 22 as desired. The diagram shown is one of many embodiments, in which the analog control voltage coming from the controller is limited by actively controlled limiting means.

Figure 3:
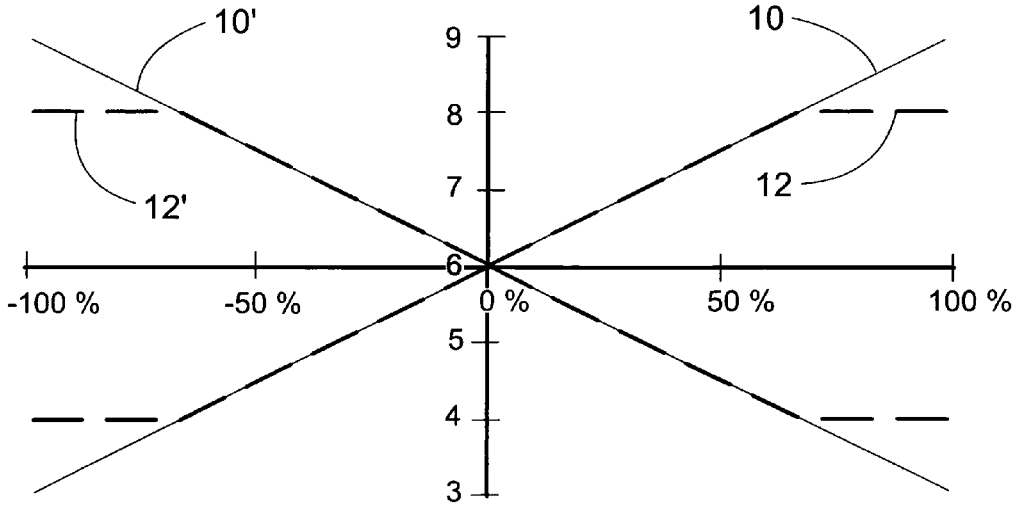
FIG. 3 shows one embodiment of the invention, in which the control voltage is limited.

Though this paragraph mainly describes FIG. 3, reference is made in the text to other figures, through the reference numbers. FIG. 3 shows an embodiment of the invention, which can be implemented using the operating system show in FIG. 2*a*. The analog control voltage 13 coming from the electromechanical controller 24 is limited using an active analog control voltage 14. The control means 28, which are low-power control means 27, are controlled on the basis of the auxiliary control signal 42 obtained from the control system 30, in which case the analog control voltage 15 going to the electrically operated directional control valve 22 can be regulated as desired. The horizontal axis of the graph show the position of the electromechanical controller 24. 100% shows that the controller 24 is turned to its extreme position. −100% shows, for its part, that the controller is turned to its opposite extreme position. The vertical axis in turn show the analog control voltage 13 coming from the controller 24. When the controller 24 is free it is in the position 0%, when the analog control voltage 13 coming, from the controller will be 6 volts. When the electromechanical controller 24 is tilted in the first direction, i.e. between 0-100%, the analog control voltage 13 coming from the controller increases, as shown by the line 10 depicting the unlimited analog control voltage. When the controller 24 is tilted in the direction opposite to the first direction, i.e. between 0-−100%, the analog control voltage 13 coming from the controller decreases, as shown by the line 10 depicting the analog control voltage 13 coming from the controller, i.e. the unlimited analog control voltage. The line 10 depicting the unlimited analog control voltage 13, i.e. the control voltage coming from the controller, shows that the analog control voltage 13 coming from the controller can vary between three and nine volts, when using a twelve-volt operating system. The line 10 depicting the analog control voltage 13 coming from the controller partly overlaps a broken line 12. The broken line 12 depicts the limited analog control voltage 15, i.e. the control voltage going to the directional control valve 22. The limited analog control voltage like that shown going to the directional control valve could appear, for example, in a situation, in which the lifting speed of the truck is limited. The analog control voltage 13 coming from the controller could then be as much as 9 volts, but the active analog control voltage 14 coming from the loading element 36 is used to limit the analog control voltage 15 going to the directional control valve to the desired level, which can be 8 volts. On the other hand, when lowering the load-handling elements 18 of the truck, the electromechanical controller 24 is tilted in the direction opposite to the first direction. The analog control voltage 13 coming from the controller can then be only 3 volts, but the analog control voltage 15 going to the directional control valve 22 can be limited, using the active analog control voltage 14 coming from the feed elements 37, which can be 4 volts. The lowering speed will then be limited to the desired level. The limit, at which analog control voltage 15 going to the directional control valve 22 is limited by the active analog control voltage 14 coning from the limiting means 27, is not fixed, but can vary actively on the basis of the measurement data obtained from the sensor 32 and the set criteria. Once the desired speed has been achieved, the analog control voltage going to the directional control valve is limited to the prevailing level. If the operator increase the analog control voltage 13 coming from the electromechanical controller 24, the active analog control voltage 14 produced by the loading elements 36 should be limited more than the analog control voltage 13 coming from the electromechanical controller 24, so that the analog control voltage 15 going to the directional control valve 22 will remain the same. The example in question is highly simplified and the control system belonging to the regulating apparatus can include even very complicated functions. The complicated functions can, for example, be used to achieve better prediction and to control the apparatus in the most optimal manner possible.

The embodiment shown in FIG. 3 can also be used in a redundant operating systems, i.e. an operating system implemented with two potentiometers and analog control voltage coming from an electromechanical controller. The potentiometers in the operating system can be set to move in opposite directions, so that they provide analog control voltages of different magnitudes. Thus, when the operator rotates the controller, the first potentiometer proves an analog control voltage, which is shown by the line 10 while the second potentiometer provides an analog control voltage, which is shown by the line 10'. The lines 10 and 10' thus depict the analog control voltage 13 coming from the controller. When the regulating apparatus 66 belonging to the operating system 16 according to the invention is not connected to the connector cable 26, i.e. the regulating apparatus is not in operation, the directional control valve 22 is controlled on the basis of the analog control voltages 13 coming from the controller 24. The use of two potentiometers makes the operation of the operating system more reliable.

Though this paragraph mainly examines FIG. 3, reference is also made in the text to reference numbers appearing in other figures. By means of the control means 28, which in connection with FIG. 2*a* are low-power control means 27, i.e. limiting means, the analog control voltage 13 coming from the electromechanical controller 24 is regulated as desired. The limiting takes place on the basis of auxiliary control signals 42 given by the control system 30 to the control means. When the controller 24 is in the position 100%, the analog control voltage, shown by the line 10, which comes from the first potentiometer 40 of the controller 24, is limited by loading. The analog control voltage 15, which is shown by the broken line 12, going to the directional control valve 22 does not rise above 8 volts. For its part, the analog control voltage 13, which is shown by the broken line 10', coming from the second potentiometer 40' of the controller 24 is limited by feeding current. Thus the analog control voltage 15, which is shown by the broken line 12', going to the directional control valve 22, is not allowed to drop below 4 volts. It can be seen from the broken line 12 that the analog control voltage 15 going to the directional control valve 22 does not drop below 4 volts, even when the controller is rotated to the position −100%, in which case the analog control voltage 13 coming from the controller 24 will be 3 volts. The broken line 12' shows that the analog control voltage 15 going to the directional control valve 22 does not rise above 8 volts, even if the controller was to be rotated to the position −100%, in which case the analog control voltage 13 coming from the controller 24 will be 9 volts. When limiting the analog control voltages in a multi-potentiometer operating system, the design should make allowance for the fact that the original operating system must not detect the limiting of the analog control voltages as an error.

FIG. 2*b* shows the replacement of the analog control voltage 13 coming from the controller 24 by an active analog control voltage 14. In the case in question, an image corresponding to FIG. 3 cannot be drawn, as the analog control voltage 15 finding its way to the electrically controller directional control valve 22 does not depend on the position of the electromechanical controller 24, i.e. on the analog control voltage 13 coming from the controller 24. The analog control voltage 15 going to the directional control valve 22 depends on the active analog control voltage 14 provided by the high-power control means 29 acting as the control means 28. The high-power control means 29 are connected in parallel with the controller. The active analog control voltage 14, with which the analog control voltage 13 coming from the controller is replaced, depends on the set criteria and measurement data.

FIG. 2*b* shows a diagram of the implementation and connection of the high-power control means 29 acting as the control means 28 in the operating system according to the invention. The analog control voltages 13 coming from both of the potentiometers 40, i.e. from the electromechanical controller 24, are replaced with an active analog control voltage 14 coming from the high-power control means 29. The analog control voltage coming from the high-power control means is such that the analog control voltage coming from the control means does not affect the operation of the directional control valve. Thus the analog control voltage 15 going to the directional control valve 22 does not depend on the analog control voltage 13 coming from the controller 24. Depending on the situation, the analog control voltage coming from the controller is loaded, or additional current is fed to it. A feed switch 48 is used to select whether the analog control voltage 13 coming from the controller 24 will be loaded or additional current will be fed to it. The values of the loading voltages 62 and feed voltages 63 coming to the feed switches 48 depend on the auxiliary control signals 42. The analog control signal 42 is preferably an analog auxiliary control voltage 43, which is amplified to the level required by a loading amplifier 64 and a feed amplifier 65. The auxiliary control signal 42 is formed by the control system 30. The control system 30 is, in turn, connected to the sensors 32 and preferably also to the user interface 34. The control means can be implemented by means of many electronic circuits, that shown in the figure being only one example. When regulating the analog control voltage 13 coming from the potentiometer 40 in the controller 24, the high-power control means 29 adjust the active analog control voltage 14 to be such that the analog control voltage 15 going to the directional control valve 22 is as desired. The analog control voltage 15 going to the directional control valve does not depend on the analog control voltage 13 coming from the controller 24, but instead the analog control voltage 15 can be regulated freely as desired with the aid of the active analog control voltage 14. The active analog control voltage 14 is summed with the analog control voltage 13 coming from the controller 24, when the active analog control voltage 14 is fed in parallel with the analog control voltage 13 coming from the controller 24. The active analog control voltage can be selected freely, so that the result of its summing in practice replaces the analog control voltage coming from the controller. When the active analog control voltage acts in parallel with the analog control voltage coming from the controller, the analog control voltage coming from the controller is replaced indirectly.

In the operating system according to the invention, the analog control voltage coming from the electromechanical controller can also be cut off entirely for some time. The cutting off of the analog control voltage coming from the controller differs from the replacement, described above, of the analog control voltage coming from the controller with an active control voltage coming from the control means in parallel with the electromechanical controller. In the method according to the invention, at least part of the time the analog control voltage coming from the electromechanical controller is regulated using a feed external to the electromechanical controller in parallel with the electromechanical controller. When the analog control voltage coming from the controller is cut off, the active analog control voltage coming from the control means is used in its place. Thus the active control voltage replaces directly the control voltage coming from the controller, forming itself the control voltage going to the directional control valve.

Figure 4:
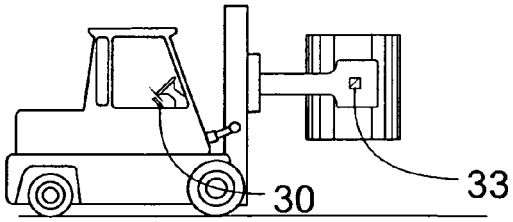
FIG. 4 shows an operating situation according to the invention, in which the truck is used to lift a load, the gripping taking place by pressing.

FIG. 4 shows the operating system according to the invention in an operating situation, in which a fork-lift truck is used to lift a load, gripping taking place by pressing. Thus the control means 28 are used to regulate the analog control voltage 15 going to the directional control valve 22, in order to regulate the compressive force directed to the load. By measuring the compressive pressure, it is possible to avoid pressing the load too strongly. The control means 28 are connected to the connection cabling 26 between the controller 24 and the directional control valve 22 (FIG. 2). A compressive-pressure sensor 33 is connected to the control system 30, so that the control system receives measurement data from the compressive-force sensor concerning the compressive force acting on the load. The criteria of the control system are preferably set using the user interface. Thus the correct compressive pressure can be defined separately for each load being handled. The definition of the criteria can take place in such a way that the operator provides the criteria. The definition of the criteria can also take place in such a way that the operator states through the operating terminal what kind the load being handled is, and then the operating system automatically searches for the correct criteria for the load. The analog control voltage coming from the controller controlling the compressive pressure is regulated typically by low-power control means, in which case the basic control takes place using the electromechanical controller.

Figure 5:
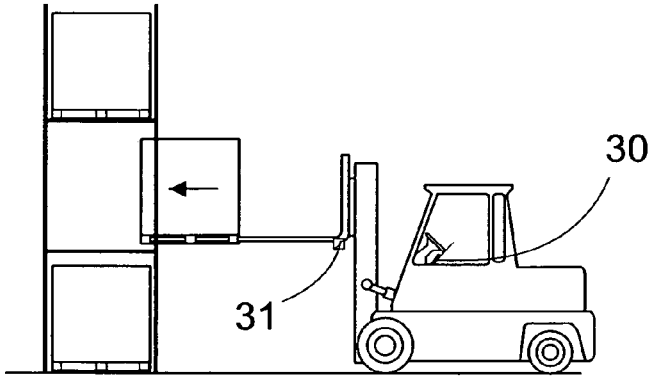
FIG. 5 shows the operating system according to the invention, in a situation, in which the truck is used to handle loads stored on shelves.

FIG. 5 shows an operating situation of the operating system according to the invention, in which a fork-lift truck is used to handle loads to be stored on a shelf. The control means 28 of the regulating apparatus are connected to the connection cabling 26 between the electromechanical controller 24 and the directional control valve 22 (FIG. 1). A height sensor 31 is connected to the control system 30, so that the control system 30 receives measurement data from the height sensor 31, concerning the height at which the load is. The operating system can then be programmed to stop the load-handling elements at the desired shelf height. The criteria of the control system are preferably set using the user interface. The interface can then be notified of the desired height, to which the load will be lifted. When the load is at the set height, the analog control voltage is set as desired, when the directional control valve regulates the operating device to stop on the basis of the criteria. The operator may use the electromechanical controller to control the load wrongly, for example, to be too high, but the command given to control means of the control system regulates the analog control voltage and takes care of the load-handling element stopping as desired, for example, at the height of the shelf.

In the operating situation of the operating system according to the invention, shown in FIG. 5, in which the truck is used to handle goods to be stored on a shelf, the stopping of the truck's load-handling elements at the shelf depends on the level of the analog control voltage, which is regulated actively on the basis of the measurement data of the set criteria. The criteria may have been set in such a way that the heights of all the shelves in the shelving are recorded in the control system. The analog control voltage can be adjusted by limiting it, or by replacing it with an active analog control voltage.

By limiting the analog control voltage coming from the controller in the case according to FIG. 5, a situation is reached, in which when the load is lifted it can be stopped as desired at the selected shelves. In this paragraph, reference is made to the embodiment relating to FIG. 3, the analog control voltage coming from the controller being 3-9 volts. When the control voltage is 6 volts, the load-handling elements are stopped. When the load is raised, the analog control voltage coming from the controller can be 6-9 volts. When the analog control voltage is 7 volts, the load-handling elements rise more slowly than when the analog control voltage is 9 volts. When the lifting height is reached, at which a possible stopping position is programmed for the load-handling elements, the control system examined the analog control voltage according to the criteria. A criterion can be, for example, that the load-handling elements are to be stopped, if the control voltage is less than 8 volts. If the analog control voltage is 8 volts or more, the regulating apparatus interprets this as meaning that the user does not wish to stop the load-handling elements at the height in question. When the load-handling elements are stopped, the analog control voltage coming from the electromechanical controller is limited to 6 volts before the voltage is conducted to the directional control valve. When the load-handling elements are stopped at a shelf, they do not continue to move for a moment, but are stopped, for example, for five seconds. When the user stops the controller in the basic state, i.e. in the position 0%, the load-handling elements still remain stationary. If the operator wants the load-handling elements to continue moving, they keep the controller switched on in the position, when the load-handling elements will continue to move. The criteria, on the basis of which a stop is made, can be set as desired using the user interface. The criterion can be defined to be, for example, that, when the analog control voltage coming from the controller, is the value zero plus 80% of the difference between the maximum value and the value zero, the load-handling elements will be stopped at the defined height. As stated above, when raising the load-handling elements, the analog control voltage is in the range 6-9 volts, in which case the zero value is 6 volts. The difference between the maximum value and the zero value is then 3 volts. When 80% of the difference to the zero value is then added, the result is 6+0.8*3=8.4 volts. A stop is then made, if the control voltage coming from the controller is 6-8.4 volts. On the other hand, when lowering the load-handling elements, the analog control voltage is in the range 3-6 volts, when the zero value is still 6 volts. The difference between the maximum value and the zero value is then −3 volts. Adding 80% of the difference to the zero value, the result obtained is 6+0.8*−3=3.6. A stop is then made, if the analog control voltage coming from the controller is 6-3.6 volts. By combining these two data, it can be stated that a stop will be made, if the analog control voltage coming from the controller is 3.6-8.4 volts. Instead of the 80-% criterion, values generally in the range 50-90%, preferably 70-80% can be used. The important fact is that a stop is only made when the control value of the lifting speed differs clearly from the control value of the maximum lifting speed, or otherwise from the control value of the lifting speed normally used in work. The operator can then, if desired, bypass shelf levels without stopping the operating system at them. The operating system will only stop lifting at the heights, at which the set criteria are met, so that work moves smoothly. The operating system brings the desired precision to finding the shelf levels, thus improving efficiency and operating certainty. Work ergonomics also improve in many cases, as the operator need not stretch their neck from the truck in order to see the shelf levels.

In the case shown in FIG. 5, replacing the analog control voltage results in a situation, in which lifting the load takes place automatically, in a manner controlled by the regulating apparatus. The term replacing refers to the fact that the control means are in parallel with the electromechanical controller and are used to load/feed the analog control voltage coming from the electromechanical controller, in such a way that the analog control voltage going to the directional control valve does not depend on the analog control voltage coming from the electromechanical controller. The operator can use the user interface to select the data of the load being lifted, in which case the load is lifted by the truck, controlled by the regulating apparatus. The information of the load can also be read for example from the bar code of the load. As the lifting takes place controlled by the regulating apparatus, when the active analog control voltage replaces the analog control voltage coming from the controller, the operator does not have to interfere with the lifting, instead the lifting takes place entirely automatically, on the basis of the measurement data and the set criteria.

In addition to the lifting height and the compressive pressure, the operating system in question can be used to limit the lifting speed. It may be necessary to limit the lifting speed, for example, if a cradle intended for lifting people is attached to the truck, when the truck operates as part of a personnel lift. The weight of the load being lifted can also be measured, in which case the operating system can be used to prevent the lifting of excessively heavy loads. In addition, the variable being measured can be the tilt of the boom, which has a considerable effect on the handling of loads.

Figure 6:
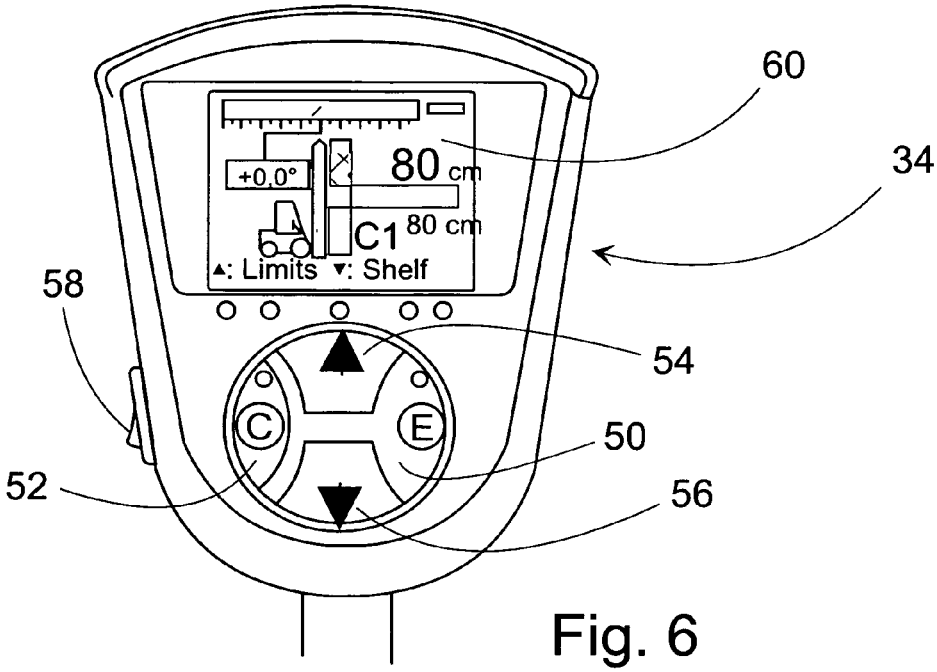
FIG. 6 shows the user interface of the active control system according to the invention.

FIG. 6 shows the user interface 34 of the active control system according to the invention. The user interface includes data-input means 50-58 and a display 60. The E key 50 is used to access the main menu when the display is in the default state. Once in the menu, the key in question can be used to select the desired function, or to accept an input value. The input values include, among others, the criteria, according to which the control system controls the regulating means. The C key 52 is used to access the menu when the display is in the default state. Once in the menu, the C key is used to move to the level of the previous menu, or to cancel the previous entry. The arrow keys 54 and 56 are used, in the default state to directly adjust the most important settings. In the menu state, the arrow keys 54 and 56 are used to browse the selections, by moving to the location of the desired alternative. In addition, the values to be entered are selected by pressing the up key 54 or the down key 56. The sound key 58 is used to switch the sounds off and on. According to the selection made, the display 60 shows either a visual view or numerical values (not shown). In the visual view, angle, distance, load weight, compressive pressure, and lifting speed and height can be shown. The unnecessary measurement variables can be omitted from the display and only the most essential shown. It is possible, for example, to show only a single measurement variable, such as lifting height or compressive pressure.

In one significant embodiment, the control voltage is limited taking into account the durability of the truck and the load-handling elements attached to it. For example, the forks used in trucks are considerably over-dimensioned, so that they will also withstand excess loads. A fork-lift truck can be intended to lift loads of 4500 kg, which are at a distance of 400 mm from the base of the forks. The truck can then also be used to lift loads of 1500 kg, which are at a distance of 1200 mm from the base of the forks. Thus the truck cannot be used to lift a load of 4500 kg, which is at a distance of 1000 mm from the base of the forks. When the load is too great, the truck may overturn or be damaged. Typically it is precisely the load-handling element that are damaged. The term location of the load refers to the location of the centre of gravity of the load.

The control voltage can be limited, for example, using the method according to the invention. The control voltage can also be cut and replaced as described in the prior art. The handling of excessively heavy loads can also be prevented using digital signal processing. The most important point is that, in the method, the parameters of the load-handling elements used by the truck are first notified to the control apparatus. The parameters define how far from the truck goods of a certain weight can be handled and the permitted weight of the load at the distance in question. In practice, the weight and centre of gravity of the load are defined. The measurement of the weight of the load can be performed, for example, from the pressure in a hydraulic cylinder. Determining the centre of gravity of the load can take place by measuring the distance between the side of the load next to the truck and the truck itself. In order to determine the centre of gravity, it is possible to further assume that the load is at the end of the load-handling elements. Once the dimension of the loading-handling elements is known, the centre of gravity can be determined. On the other hand, the determining of the centre of gravity can also be based on knowing the dimensions of the load being handled. When the load-handling elements are the forks of the truck, there can be several measuring elements in the forks for measuring the pressure. Further, the information obtained from these measuring elements can be used to determine the location of the centre of gravity.

The invention is in no way restricted to the embodiments described above, but can be applied according to the Claims to many applications, while the inventive characteristic remains the same.

The invention claimed is:

1. Method for controlling the load-handling elements of a fork-lift truck, the load-handling elements being used in the method to grip the load to be handled, and the load-handling elements being operated using an electrically controlled operating device, which is controlled using an analog control voltage formed using an electromechanical controller, characterized in that the analog control voltage coming from the electromechanical controller is regulated actively externally on the basis of measurement data and set criteria, before the analog control voltage formed by the electromechanical controller is conducted to the electrically controlled operating element, and the analog control voltage coming from the electromechanical controller is regulated using a feed external to the electromechanical controller, in parallel with the electromechanical controller.

2. Method according to claim 1, characterized in that the analog control voltage coming from the electromechanical controller is loaded with an active analog control voltage.

3. Method according to claim 1, characterized in that the analog control voltage coming from the electromechanical controller is fed with an active analog control voltage.

4. Operating system for controlling the load-handling elements of a fork-lift truck, the operating system including:

an electrically controlled operating element, an electromechanical controller for forming an analog control voltage for controlling an electrically controlled operating device, connector cabling between the electromechanical controller and the electrically controlled operating device, for transmitting the analog control voltage arranged to come from the electromechanical controller, characterized in that, in addition, the operating system includes control means, which are arranged to actively regulate as desired the analog control voltage arranged to come from the electromechanical controller, before the analog control voltage arranged to come from the electromechanical controller is conducted to the electrically controlled operating element, connection means for connecting the control means in parallel with the electromechanical controller, an active control system for controlling the control means, and at least one sensor for acquiring measurement information for the control system.

5. Operating system according to claim 4, characterized in that the operating system includes, in addition, a user interface for setting criteria.

6. Operating system according to claim 4, characterized in that the control means are low-power control means.

7. Operating system according to claim 4, characterized in that the control means are high-power control means.

8. Operating system according to claim 4, characterized in that the control means include a loading element.

9. Operating system according to claim 4 characterized in that the control means include a feed element.

10. Operating system according to claim 4, characterized in that the operating element includes an operating device for operating the load-handling element and an electrically controlled directional control valve for operating the operating device.

11. Regulating apparatus for controlling the operating system of the load-handling elements of a fork-lift truck, the operating system includes an electrically operated operating element for operating a load-handling element, an electromechanical controller for forming an analog control voltage for controlling the electrically operated operating element, connector cabling between the electromechanical controller and the electrically operated operating element for transmitting the analog control voltage arranged to come from the electromechanical controller characterized in that the regulating apparatus includes connecting means for connecting the regulating apparatus to connection cabling in parallel with the electromechanical controller, control means, which are arranged to actively regulate as desired the analog control voltage arranged to come from the electromechanical controller, before the analog control voltage goes to the directional control valve, an active control system (30) for controlling the control means, and at least one sensor for acquiring measurement information for the control system.

* * * * *